US007363858B2

(12) United States Patent
Edamitsu et al.

(10) Patent No.: US 7,363,858 B2
(45) Date of Patent: Apr. 29, 2008

(54) PRINTING APPARATUS WITH PLATE FEEDING MECHANISM HAVING TRANSPORT ROLLERS

(75) Inventors: Kenji Edamitsu, Kyoto (JP); Masahiko Takeuchi, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 389 days.

(21) Appl. No.: 11/079,337

(22) Filed: Mar. 15, 2005

(65) Prior Publication Data

US 2005/0229802 A1 Oct. 20, 2005

(30) Foreign Application Priority Data

Apr. 14, 2004 (JP) ..... 2004-119083

(51) Int. Cl.
*B41F 27/12* (2006.01)

(52) U.S. Cl. ..... 101/477; 101/415.1

(58) Field of Classification Search ..... 101/477
See application file for complete search history.

(56) References Cited

U.S. PATENT DOCUMENTS 5,127,328 A * 7/1992 Wieland ..... 101/415.1

7,055,432 B2 * 6/2006 Kan et al. ..... 101/477

FOREIGN PATENT DOCUMENTS

JP 11-77965 3/1999

* cited by examiner

*Primary Examiner*—Leslie J. Evanisko
(74) *Attorney, Agent, or Firm*—McDermott Will & Emery LLP

(57) ABSTRACT

A printing apparatus includes a printing plate feeder for feeding printing plates to a first plate cylinder. The printing plate feeder has a pair of transport rollers acting as a leveling roller and a driven roller. The leveling roller is fixed to a leveling roller rotary shaft extending parallel to a rotational axis of the first plate cylinder, and is opposed to middle and opposite end regions of the first plate cylinder. The leveling roller rotary shaft is connected to a driving device, a one-way clutch for permitting rotation only in a transport direction of the printing plates, and a torque transmission clutch acting as a loading device for applying a load to rotation in a direction opposite to the transport direction of the printing plates.

7 Claims, 9 Drawing Sheets

PRINTING APPARATUS WITH PLATE FEEDING MECHANISM HAVING TRANSPORT ROLLERS

BACKGROUND OF THE INVENTION

1. Field of the Invention

This invention relates to a printing apparatus having a plate cylinder for supporting printing plates mounted peripherally thereof, and a plate feeder disposed between the plate cylinder and a storage cassette storing an unexposed plate stock for holding and transporting printing plates to the plate cylinder. This invention relates also to a printing plate mounting method for mounting printing plates on the plate cylinder.

2. Description of the Related Art

A known printing apparatus as noted above is described in Japanese Unexamined Patent Publication No. 11-77965 (1999), for example.

The apparatus described in the above publication includes a forward end clamp mechanism arranged on the plate cylinder and having a clamp and a clamp seat. The clamp and clamp seat hold therebetween the forward end of a printing plate mounted peripherally of the plate cylinder. This apparatus further includes a squeeze roller movable between a squeeze position adjacent the surface of the plate cylinder for squeezing, against the periphery of the plate cylinder, the printing plate having the forward end thereof held between the clamp and clamp seat of the forward end clamp mechanism, and a standby position spaced away from the surface of the plate cylinder. Thus, the above apparatus can mount the printing plate peripherally of the plate cylinder in an extended state, without slackening the printing plate.

However, where a printing plate formed of a highly elastic material is used, the plate can free itself from an extended state and become slack after being pressed against the peripheral surface of the plate cylinder by the squeeze roller in the apparatus described in Japanese Unexamined Patent Publication No. 11-77965 (1999). Such slackening is notable particularly with printing plates formed of a highly elastic material or having curls.

SUMMARY OF THE INVENTION

The object of this invention, therefore, is to provide a printing apparatus and a printing plate mounting method capable of mounting a blank printing plate peripherally of a plate cylinder without slackening the printing plate.

The above object is fulfilled, according to this invention, by a printing plate mounting method for mounting printing plates peripherally of a plate cylinder of a printing apparatus, the plate cylinder having a forward end clamp mechanism for holding a forward end of each printing plate, and a rear end clamp mechanism for holding a rear end of each printing plate, the printing apparatus including a plate feed mechanism arranged between a storage unit storing printing plates to be exposed and the plate cylinder, and having a driving device for rotating at least a pair of transport rollers to feed the printing plates from the storage unit to the plate cylinder, the method comprising a transport step for transporting a printing plate from the storage unit to the plate cylinder by causing the driving device to rotate the pair of transport rollers, a drive stopping step for causing the driving device to stop rotation of the transport rollers when the forward end of the printing plate is in a position ready to be held by the forward end clamp mechanism, a forward end holding step for causing the forward end clamp mechanism to hold the forward end of the printing plate, a plate cylinder rotating step for rotating the plate cylinder, with the rotation of the pair of transport rollers stopped, and a load applied by a loading device to at least one of the pair of transport rollers, a plate cylinder stopping step for stopping rotation of the plate cylinder when, with the rotation of the plate cylinder, the rear end of the printing plate has moved to a position ready to be held by the rear end clamp mechanism, and a rear end holding step for causing the rear end clamp mechanism to hold the rear end of the printing plate.

With this method, the printing plate may be mounted peripherally of the plate cylinder without slackening the plate.

In a preferred embodiment, the plate cylinder rotating step is executed while the printing plate is squeezed by a squeeze roller against a peripheral surface of the plate cylinder.

In another preferred embodiment, the loading device applies the load to one of the pair of transport rollers that contacts a back surface of the printing plate.

In another aspect of the invention, a printing apparatus is provided which includes a plate cylinder having a forward end clamp mechanism for holding a forward end of a printing plate, and a rear end clamp mechanism for holding a rear end of the printing plate, a storage unit storing printing plates to be exposed, and a plate feed mechanism arranged between the storage unit and the plate cylinder for feeding the printing plates from the storage unit to the plate cylinder, the plate feed mechanism comprising at least a pair of transport rollers, a driving device for rotating at least one of the pair of transport rollers, a one-way clutch disposed between the driving device and the one transport roller driven by the driving device, for allowing the one transport roller to rotate freely in a transport direction of the printing plates, and a loading device for applying a load to at least one of the pair of transport rollers when the at least one transport roller rotates in the transport direction of the printing plates.

Other features and advantages of the invention will be apparent from the following detailed description of the embodiment of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENT

Figure 1:
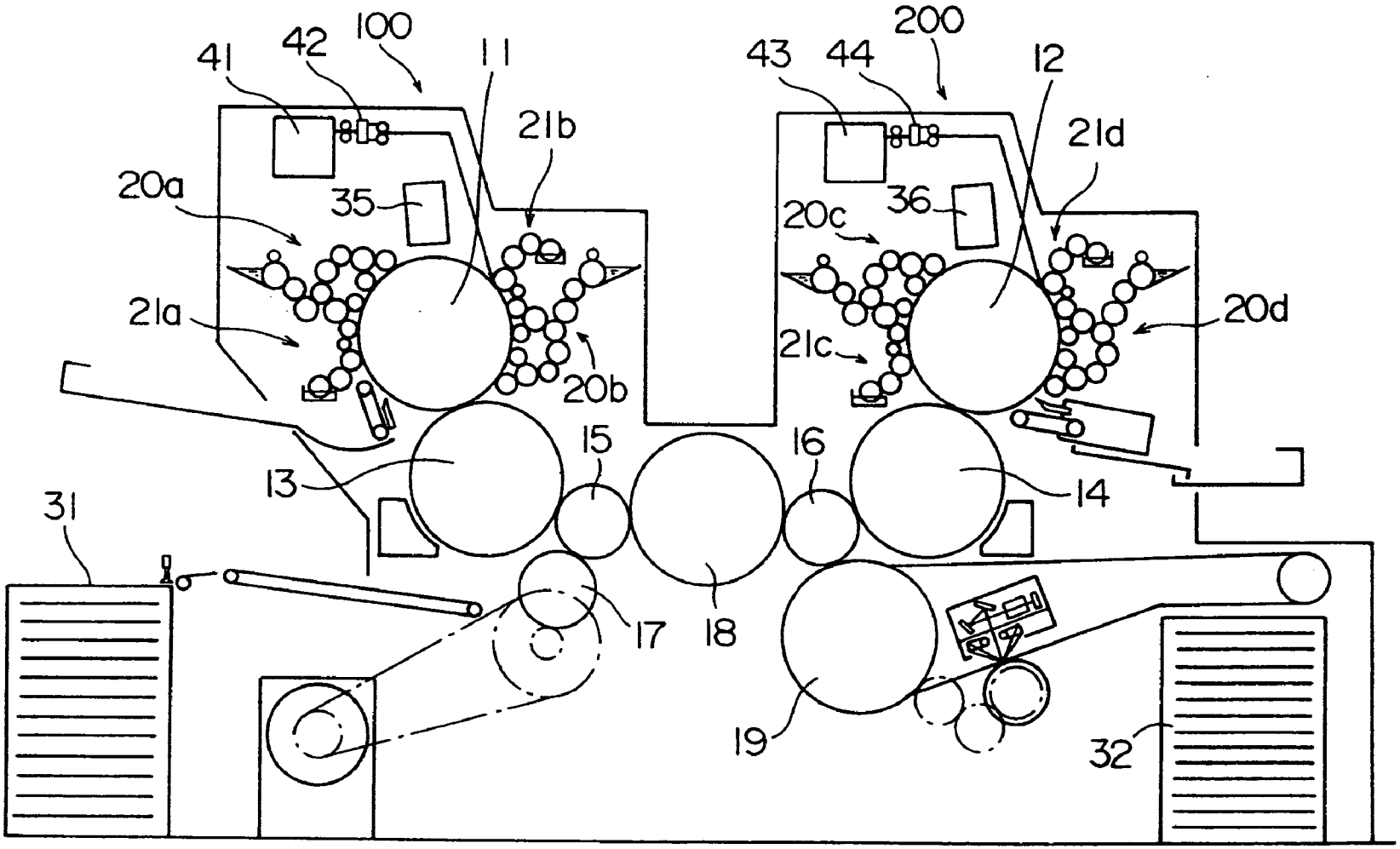
FIG. 1 is a schematic side view of a printing apparatus according to this invention.

An embodiment of this invention will be described hereinafter with reference to the drawings. FIG. 1 is a schematic side view of a printing apparatus according to this invention.

This printing apparatus records images on printing plates mounted, two each, on first and second plate cylinders 11 and 12 in a prepress process, feeds inks to the plates having the images recorded thereon, and transfers the inks from the plates through blanket cylinders to printing paper held on impression cylinders 15 and 16, thereby printing the images on the printing paper.

The printing apparatus has the first plate cylinder 11, the second plate cylinder 12, a plate feeder 100 for feeding printing plates to be mounted on the peripheral surface of the first plate cylinder 11, a plate feeder 200 for feeding printing plates to be mounted on the peripheral surface of the second plate cylinder 12, a first blanket cylinder 13 contactable with the first plate cylinder 11, a second blanket cylinder 14 contactable with the second plate cylinder 12, the first impression cylinder 15 contactable with the first blanket cylinder 13, and the second impression cylinder 16 contactable with the second blanket cylinder 14. The printing apparatus further includes a paper feed cylinder 17 for transferring printing paper supplied from a paper storage station 31 to the first impression cylinder 15, a transfer cylinder 18 for transferring the printing paper from the first impression cylinder 15 to the second impression cylinder 16, and a paper discharge cylinder 19 disposed adjacent the second impression cylinder 16.

The first impression cylinder 15 movable into contact with the first blanket cylinder 13 has half the diameter of the first plate cylinder 11 and first blanket cylinder 13. The second impression cylinder 16 movable into contact with the second blanket cylinder 14 has half the diameter of the second plate cylinder 12 and second blanket cylinder 14. The first and second impression cylinders 15 and 16 have grippers, not shown, for holding and transporting the forward end of printing paper.

The paper feed cylinder 17 disposed adjacent the first impression cylinder 15 has the same diameter as the first impression cylinder 15. The paper feed cylinder 17 has a gripper, not shown, for holding and transporting the forward end of each sheet of printing paper successively fed from the paper storage station 31. When the printing paper is transferred from the feed cylinder 17 to the first impression cylinder 15, the gripper of the first impression cylinder 15 holds the forward end of the printing paper which has been held by the gripper of the feed cylinder 17.

The transfer cylinder 18 disposed between the first impression cylinder 15 and second impression cylinder 16 has the same diameter as the first and second plate cylinders 11 and 12 and the first and second blanket cylinders 13 and 14. The transfer cylinder 18 has a gripper, not shown, for holding and transporting the forward end of the printing paper received from the first impression cylinder 15, and transferring the forward end of the printing paper to the gripper of the second impression cylinder 16.

The paper discharge cylinder 19 disposed adjacent the second impression cylinder 16 has the same diameter as the first and second plate cylinders 11 and 12 and the first and second blanket cylinders 13 and 14. The discharge cylinder 19 has a pair of chains wound around opposite ends thereof. The chains are interconnected by coupling members, not shown, having grippers arranged thereon. When the second impression cylinder 16 transfers the printing paper to the discharge cylinder 19, one of the grippers on the discharge cylinder 19 holds the forward end of the printing paper having been held by the gripper of the second impression cylinder 16. With movement of the chains, the printing paper is transported to a paper discharge station 32 to be discharged thereon.

The first and second impression cylinders 15 and 16, paper feed cylinder 17, paper discharge cylinder 19 and first and second blanket cylinders 13 and 14 are interlocked to one another through gears attached to ends thereof, respectively. Further, the first blanket cylinder 13 and first plate cylinder 11 are interlocked to each other, and the second blanket cylinder 14 and second plate cylinder 12 are interlocked to each other, through gears attached to ends thereof, respectively. Thus, the first and second plate cylinders 11 and 12, first and second impression cylinders 15 and 16, paper feed cylinder 17, paper discharge cylinder 19 and first and second blanket cylinders 13 and 14 are synchronously rotatable by a drive motor.

The first plate cylinder 11 is surrounded by an ink feeder 20*a* for feeding an ink of black (K), for example, to a printing plate mounted peripherally of the first plate cylinder 11, an ink feeder 20*b* for feeding an ink of magenta (M), for example, to a printing plate mounted peripherally of the first plate cylinder 11, a dampening water feeder 21*a* for feeding dampening water to areas of the printing plate to which the ink is to be fed from the ink feeder 20*a*, and a dampening water feeder 21*b* for feeding dampening water to areas of the printing plate to which the ink is to be fed from the ink feeder 20*b*. The second plate cylinder 12 is surrounded by an ink feeder 20*c* for feeding an ink of cyan (C), for example, to a printing plate mounted peripherally of the second plate cylinder 12, an ink feeder 20*d* for feeding an ink of yellow (Y), for example, to a printing plate mounted peripherally of the second plate cylinder 12, a dampening water feeder 21*c* for feeding dampening water to areas of the printing plate to which the ink is to be fed from the ink feeder 20*c*, and a dampening water feeder 21*d* for feeding dampening water to areas of the printing plate to which the ink is to be fed from the ink feeder 20*d*.

Further, arranged around the first and second plate cylinders 11 and 12 are the plate feeder 100 for feeding plates stored in a storage cassette 41 to the peripheral surface of the first plate cylinder 11, the plate feeder 200 for feeding plates stored in a storage cassette 43 to the peripheral surface of the second plate cylinder 12, an image recorder 35 for recording images on the plates mounted peripherally of the first plate cylinder 11, and an image recorder 36 for recording images on the plates mounted peripherally of the second plate cylinder 12.

Figure 2:
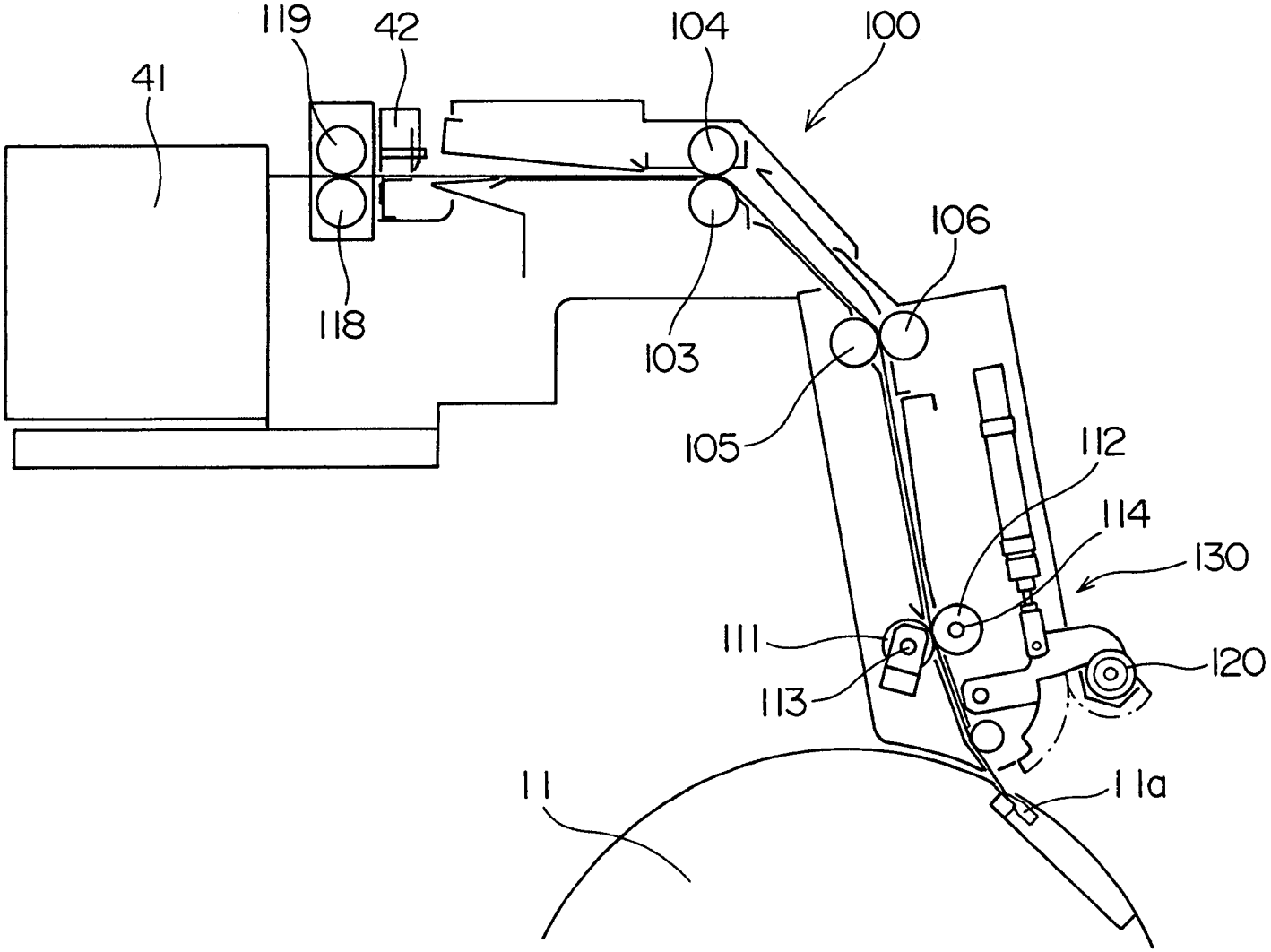
FIG. 2 is a schematic view showing a plate feeder, along with a storage cassette, a squeeze roller, a squeeze roller moving mechanism and a first plate cylinder, of the printing apparatus.

FIG. 2 is a schematic view showing the plate feeder 100 along with the storage cassette 41, a squeeze roller 120, a squeeze roller moving mechanism 130 and the first plate cylinder 11, of the printing apparatus according to the invention. A plate feeder 200, storage cassette 43, squeeze roller, and squeeze roller moving mechanism arranged around the second plate cylinder 12 have the same construction as the plate feeder 100 and so on arranged around the first plate cylinder 11, and will not be described.

As shown in FIG. 2, the first plate cylinder 11 has a forward end clamp mechanism 11*a* for holding the forward end of a printing plate fed by the plate feeder 100, and a rear end clamp mechanism, not shown, for holding the rear end of the printing plate.

The plate feeder 100 extends between the storage cassette 41 for storing a printing plate stock in rolled form, and the first plate cylinder 11. The plate feeder 100 includes a cutter 42 for cutting the printing plate stock to a predetermined length, and a pair of first rollers 103 and 104, a pair of second rollers 105 and 106, a pair of third rollers 118 and 119 and a pair of transport rollers 111 and 112 for transporting printing plates from the storage cassette 41 to the first plate cylinder 11.

Figure 3:
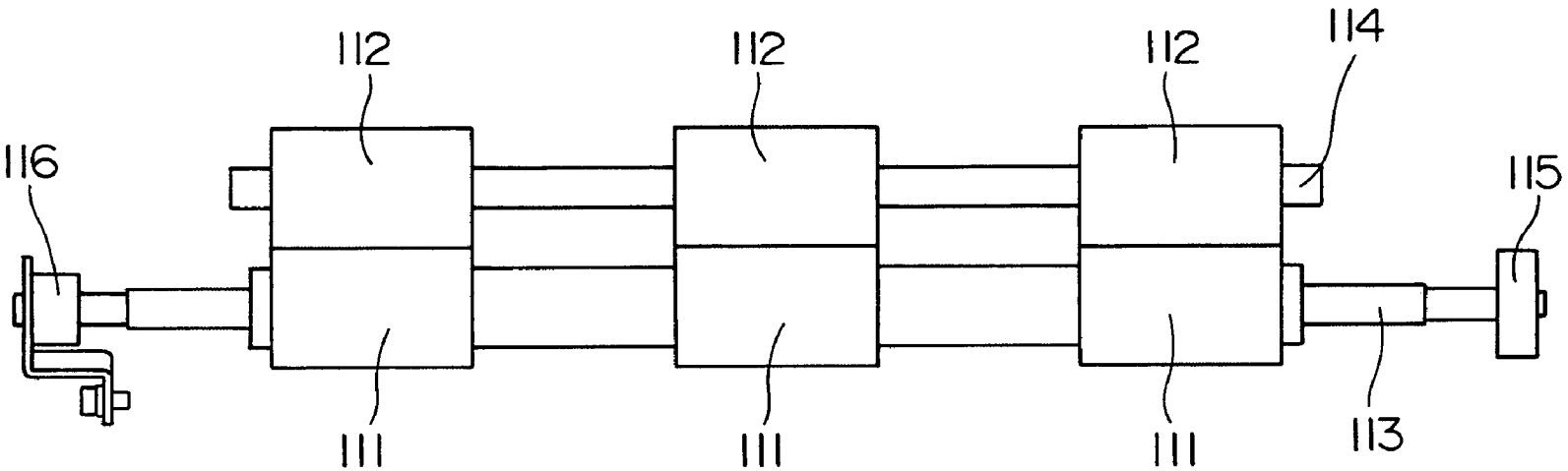
FIG. 3 is a front view showing a pair of transport rollers of the plate feeder in FIG. 2.

FIG. 3 is a front view showing the pair of transport rollers 111 and 112 of the plate feeder 100 in FIG. 2.

Of the pair of transport rollers 111 and 112, the transport roller 111 arranged to contact the back surface of each printing plate is a transport roller for leveling the printing plate by applying a load thereto. This transport roller is hereinafter called "leveling roller 111". The transport roller 112 forming the pair with the leveling roller 111 and arranged to contact the front surface of the printing plate is a transport roller freely rotatable for guiding the printing plate. This transport roller is hereinafter called "driven roller 112". The back surface of the printing plate refers to the surface that contacts the peripheral surface of the first plate cylinder 11 when mounted on the first plate cylinder 11. The front surface of the printing plate refers to the surface that has an image recording layer formed thereon for an image to be recorded by the image recorder 35.

The leveling roller 111 is fixed to a leveling roller rotary shaft 113 extending parallel to the rotational axis of the first plate cylinder 11, in positions opposed to the middle and end regions of the first plate cylinder 11. The leveling roller rotary shaft 113 is connected to a motor 117 (FIG. 6) acting as a driving device for rotating the leveling roller 111, a one-way clutch 115 for allowing the leveling roller 111 to rotate freely in a plate transporting direction, and a torque transmission clutch 116 acting as a loading device for applying a load to the leveling roller 111 rotating in the plate transporting direction. The one-way clutch 115 and torque transmission clutch 116 are arranged between the motor 117 and the leveling roller 111. In this specification, the torque transmission clutch means a clutch for transmitting and cutting off a torque load to the rotary shaft connected thereto. The torque transmission clutch 116 used in this embodiment is a powder clutch that transmits torque through a special magnetic powder. The use of this powder clutch minimizes impact produced in time of making and breaking the torque load transmission, to realize a smooth operation.

The driven roller 112 is fixed to a driven roller rotary shaft 114 extending parallel to the leveling roller rotary shaft 113, in positions opposed to the leveling roller 111 fixed to the leveling roller rotary shaft 113. The driven roller rotary shaft 114 is connected to a one-way clutch, not shown, to be rotatable at a speed corresponding to the speed of a printing plate moving past the leveling roller 111 and driven roller 112.

The first roller 103, second roller 105 and third roller 118 which contact the back surface of the printing plate have rotary shafts thereof connected to the motor 117 and one-way clutches, respectively, as does the leveling roller 111. The first roller 104, second roller 106 and third roller 119 which contact the front surface of the printing plate have rotary shafts thereof connected to one-way clutches, respectively, as does the driven roller 112. Thus, even after the motor 117 stops driving the first roller 103 and second roller 105, the printing plate is transported without slips occurring between the printing plate, and the pair of first rollers 103 and 104 and the pair of second rollers 105 and 106. Consequently, the printing plate is transported, free from scratches, between the first rollers 103 and 104 and between second rollers 105 and 106.

Figure 4:
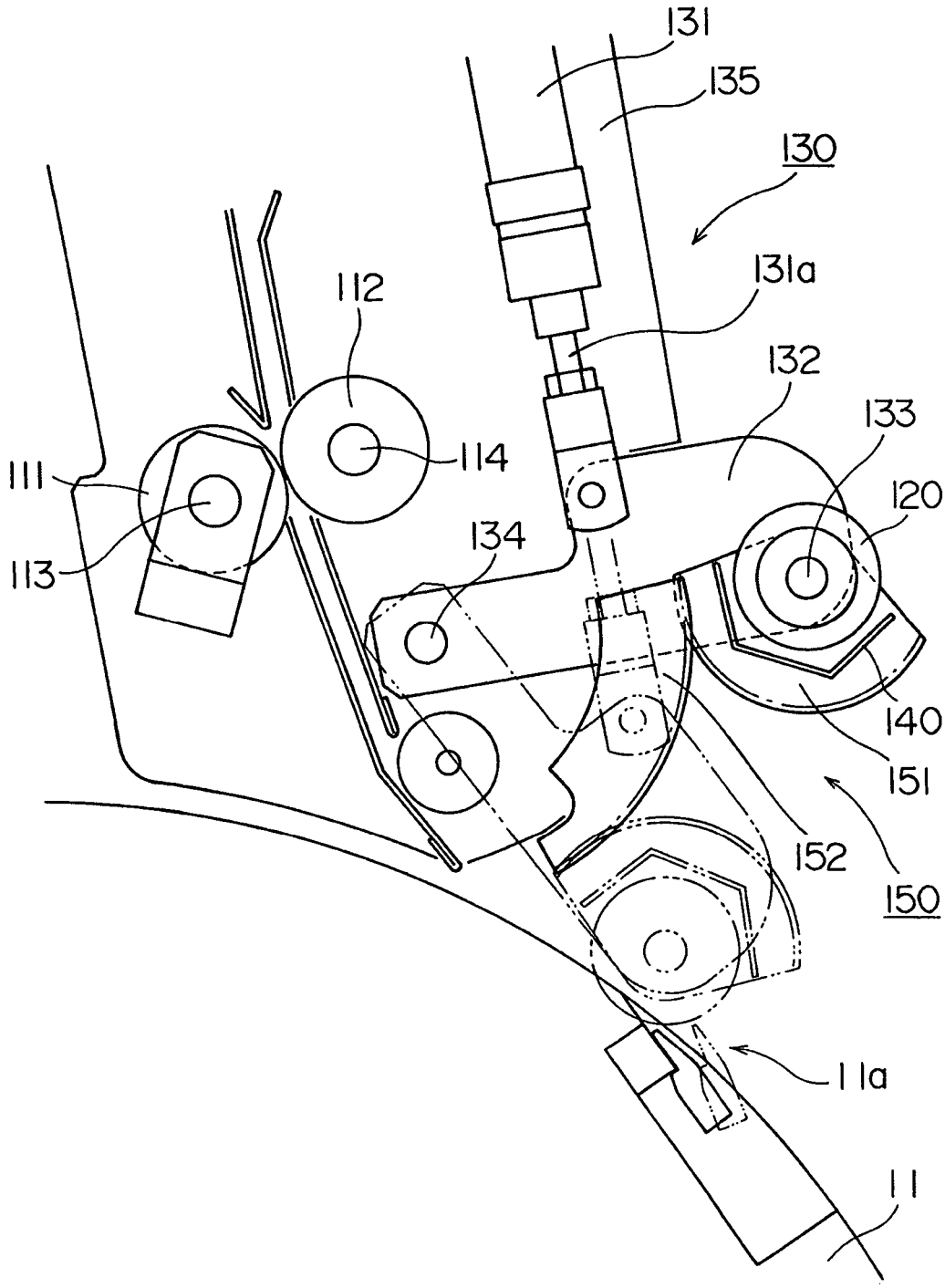
FIG. 4 is a schematic side view showing a leveling roller, a driven roller, a shield, a shield moving mechanism, the squeeze roller and a principal portion of the squeeze roller moving mechanism of the printing apparatus.
Figure 5:
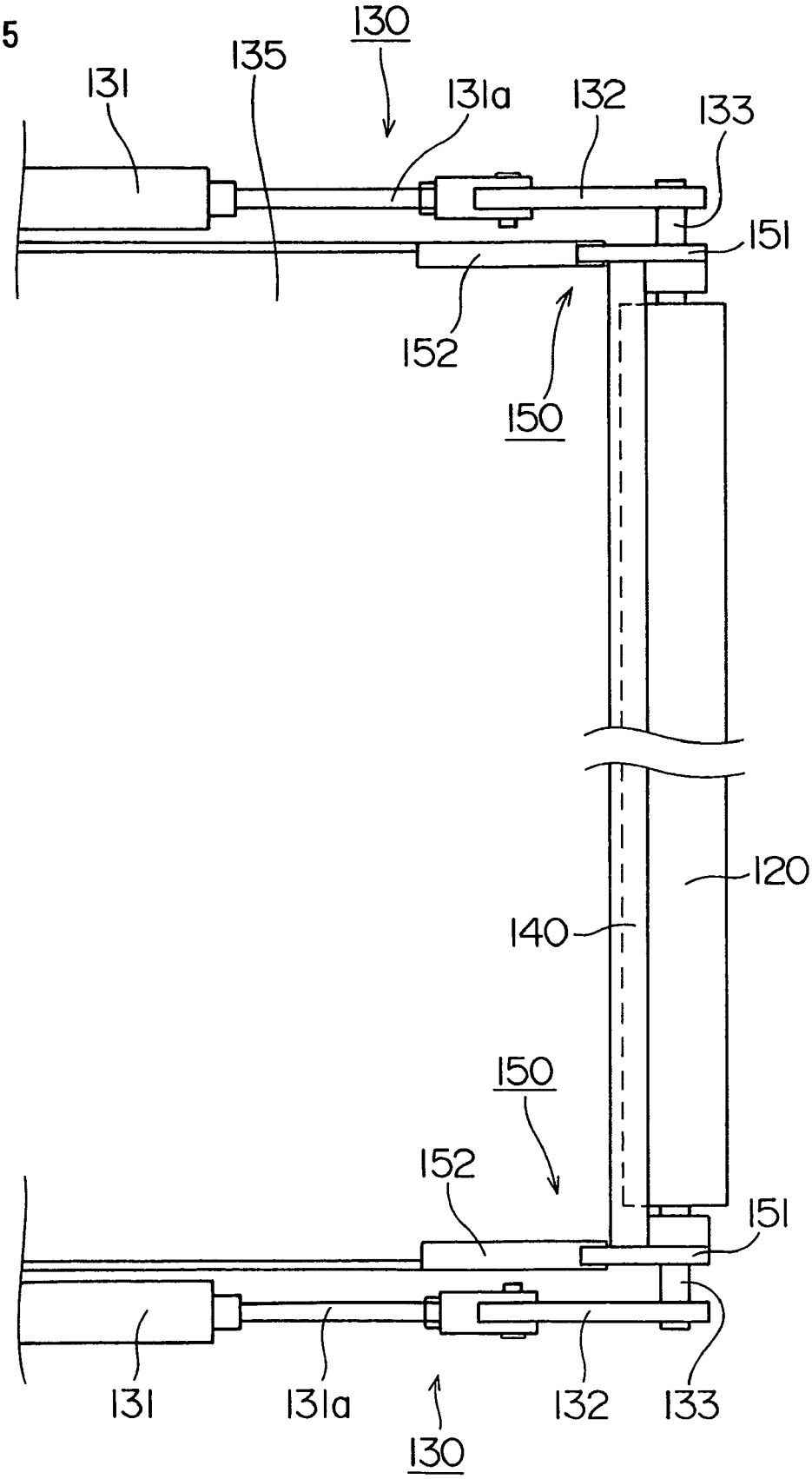
FIG. 5 is an explanatory plan view showing in development an arrangement of the shield, shield moving mechanism, squeeze roller and squeeze roller moving mechanism of the printing apparatus.

FIG. 4 is a schematic side view showing the leveling roller 111, driven roller 112, a shield 140, a shield moving mechanism 150, the squeeze roller 120 and a principal portion of the squeeze roller moving mechanism 130 of the printing apparatus according to the invention. FIG. 5 is an explanatory plan view showing in development an arrangement of the shield 140, shield moving mechanism 150, squeeze roller 120 and squeeze roller moving mechanism 130 of the printing apparatus according to the invention.

The squeeze roller 120 serves to squeeze the printing plate against the peripheral surface of the first plate cylinder 11. The squeeze roller 120 is rotatable about a squeeze roller rotary shaft 133. The squeeze roller 120 is driven by the squeeze roller moving mechanism 130 to move between a standby position spaced away from the peripheral surface of the first plate cylinder 11 as shown in solid lines in FIG. 4, and a squeeze position adjacent the peripheral surface of the first plate cylinder 11 as shown in two-dot chain lines in FIG. 4. When the squeeze roller 120 is placed in the standby position, the shield 140 interposes between the squeeze roller 120 and the first plate cylinders 11.

The squeeze roller moving mechanism 130 includes a support member 135, air cylinders 131 supported by the support member 135 to be extendible and contractible in directions perpendicular to the rotational axis of the first plate cylinder 11, and transmission arms 132 connected to cylinder rods 131*a* of the air cylinders 131 to be pivotable about an axis 134 by the extension and contraction of the air cylinders 131. The squeeze roller 120 is supported by free ends of the transmission arms 132 to be rotatable about the squeeze roller rotary shaft 133. Thus, a pivotal movement of the transmission arms 132 moves the squeeze roller 120 arcuately about the axis 134. This arrangement of the squeeze roller 120 and squeeze roller moving mechanism 130 requires a reduced space, and allows the squeeze roller 120 to squeeze the printing plate, starting in a position of the plate immediately following the position held by the forward end clamp mechanism 11*a*.

The shield 140 interposes between the squeeze roller 120 and the first plate cylinders 11 when the squeeze roller 120 is placed in the standby position, and serves to protect the squeeze roller 120 from contaminants such as ink droplets scattering inside the printing apparatus. In this embodiment, the shield 140 has a recessed shape covering an approximately semicircular range around the surface of the squeeze roller 120. The shield 140 is driven by the shield moving mechanism 150 to move between a shielding position interposed between the squeeze roller 120 and the first plate cylinders 11 as shown in solid lines in FIG. 4, and an open position for opening an area between the squeeze roller 120 and the first plate cylinders 11 as shown in two-dot chain lines in FIG. 4.

The shield moving mechanism 150 includes racks 152 arranged on the support member 135, and gears 151 arranged coaxially with the squeeze roller rotary shaft 133. Each rack 152 has a row of teeth formed circumferentially thereof and meshed with one of the gears 151. The shield 140 is fixed to the gears 151. Thus, the gears 151 cooperate with the racks 152 to rotate the shield 140 about the squeeze roller rotary shaft 133 as the transmission arms 132 make a pivotal movement. This rotates the shield 140 synchronously with movement of the squeeze roller 120. This arrangement can easily match the timing of the squeeze roller 120 moving to the squeeze position, and the timing of the shield 140 moving to the open position.

Figure 6:
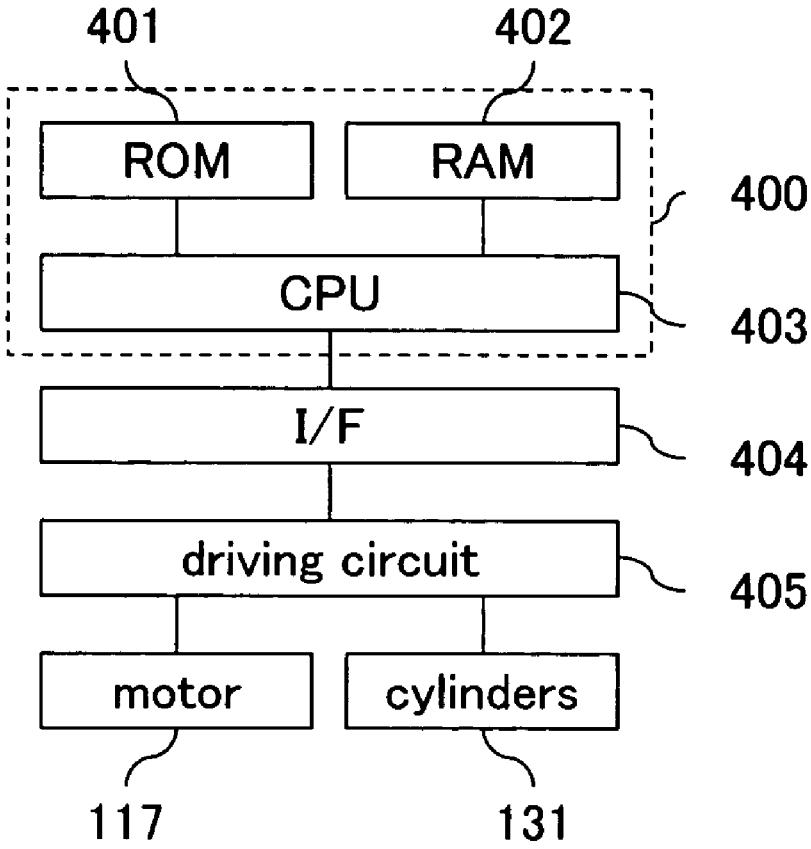
FIG. 6 is a block diagram showing a principal electrical structure of the printing apparatus.

FIG. 6 is a block diagram showing a principal electrical structure of the printing apparatus. This printing apparatus includes a control unit 400 having a ROM 401 for storing operating programs necessary for controlling the apparatus, a RAM 402 for temporarily storing data and the like during a control operation, and a CPU 403. The control unit 400 has a driving circuit 405 connected thereto through an interface 404, for generating driving signals for the motor 117 to rotate the leveling roller 111, and for the air cylinders 131 acting as the power source for movement of the squeeze roller 120. The printing apparatus is controlled by this control unit 400 to perform a printing plate attaching operation described hereinafter.

Figure 7:
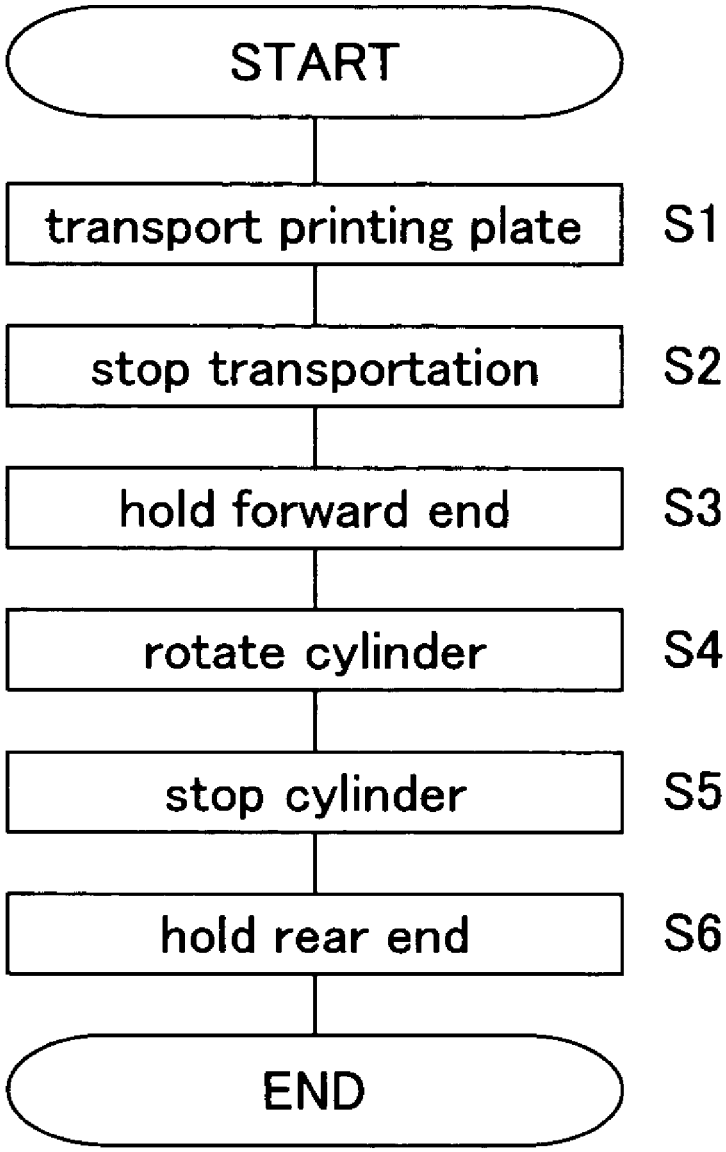
FIG. 7 is a flow chart showing a process of attaching a blank printing plate to the first plate cylinder of the printing apparatus.

FIG. 7 is a flow chart showing a process of attaching a blank printing plate to the first plate cylinder 11 of the printing apparatus according to the invention.

In the printing apparatus according to the invention described above, when attaching a printing plate to the first plate cylinder 11, the pair of third rollers 118 and 119 are first driven to draw the printing plate stock in rolled form from the storage cassette 41. When a predetermined length of the plate stock is drawn out, the cutter 42 cuts out a printing plate. The cut printing plate is transported to the first plate cylinder 11 by rotation of the rollers 103, 104, 105, 106, 111 and 112 (step S1).

The printing plate is transported to the first plate cylinder 11 in step S1, and when the forward end of the printing plate has reached a position ready to be held by the forward end clamp mechanism 11*a*, the motor 117 stops the rotation of the leveling roller 111 (step S2). This stops also the transportation of the printing plate to the first plate cylinder 11. Whether the forward end of the printing plate has reached the position ready to be held by the forward end clamp mechanism 11*a* may be determined from a driving time of the motor 117, or from a detection by a sensor not shown.

After the motor 117 stops the rotation of the leveling roller 111 in step S2, the forward end of the printing plate is held by the forward end clamp mechanism 11*a* (step S3).

Next, the squeeze roller 120 in the standby position is moved to the squeeze position, to squeeze the printing plate against the peripheral surface of the first plate cylinder 11.

Figure 8:
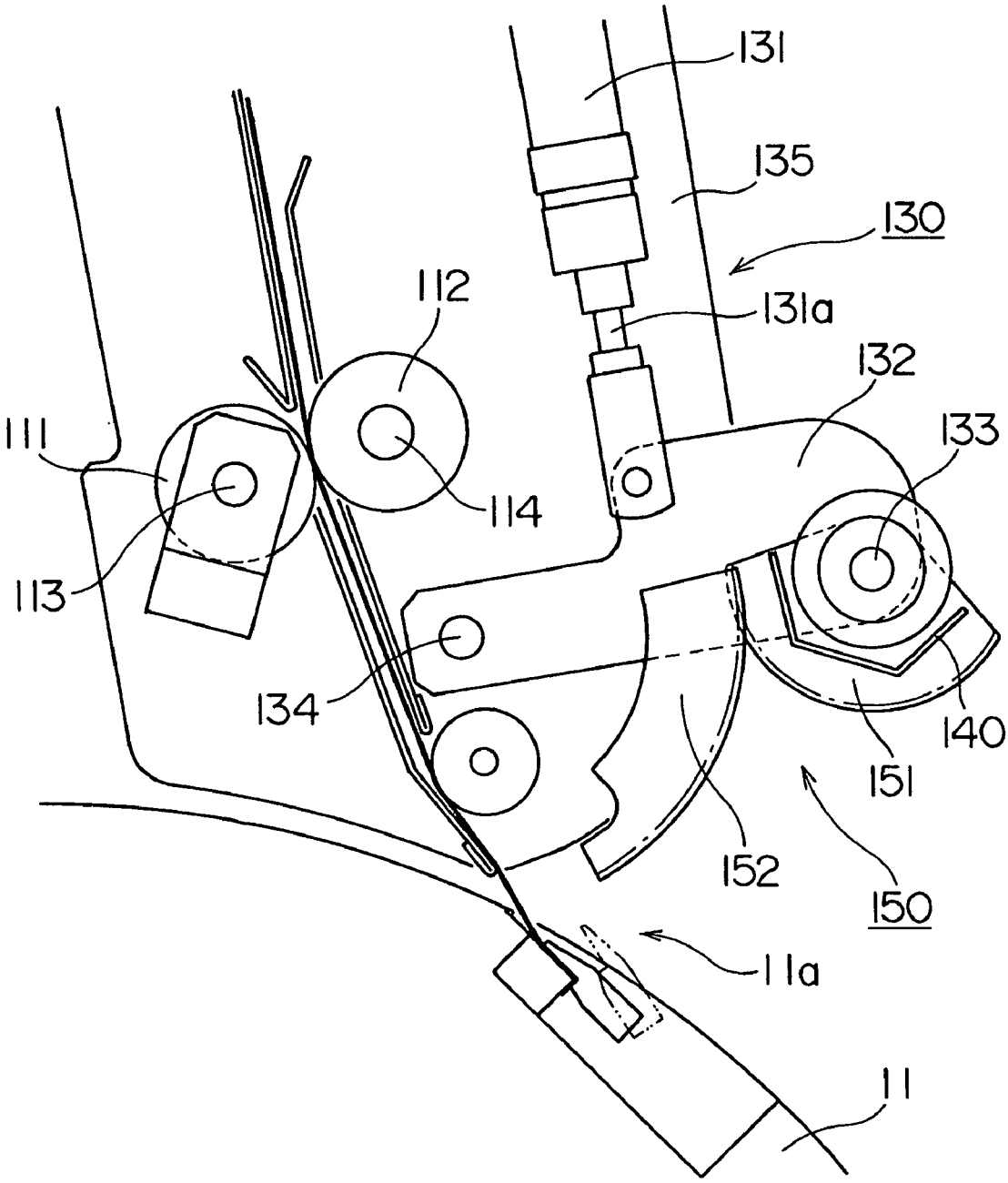
FIG. 8 is a schematic side view showing the squeeze roller in a standby position.
Figure 9:
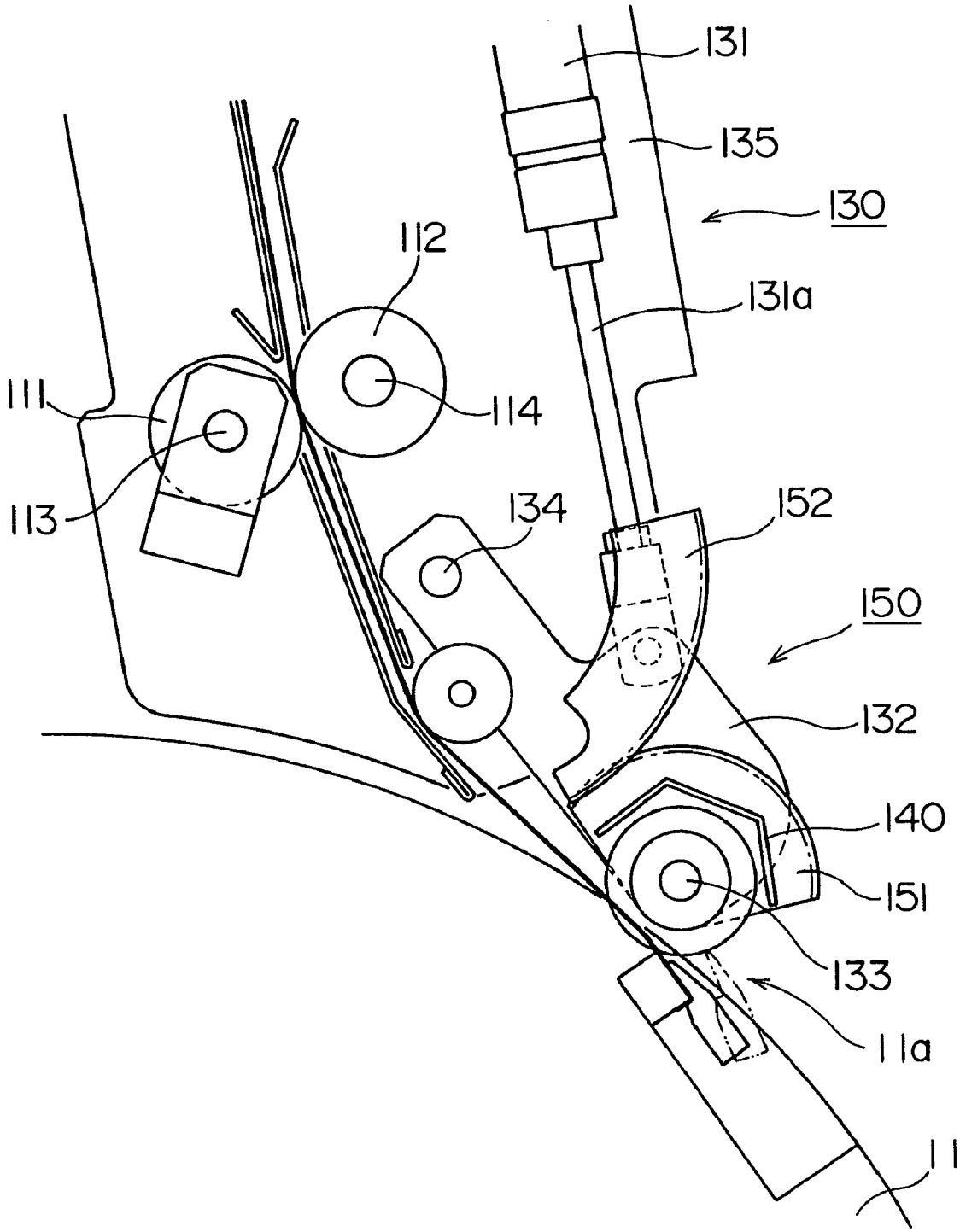
FIG. 9 is a schematic side view showing the squeeze roller in a squeeze position.

The movement of the squeeze roller 120 between the standby position and squeeze position will be described with reference to FIGS. 8 and 9. FIG. 8 is a schematic side view showing the squeeze roller 120 in the standby position. FIG. 9 is a schematic side view showing the squeeze roller 120 in the squeeze position.

When moving the squeeze roller 120 from the standby position shown in FIG. 8 to the squeeze position shown in FIG. 9, the cylinder rods 131*a* of the air cylinders 131 are first extended in the direction perpendicular to the rotational axis of the first plate cylinder 11. With the extension of the cylinder rods 131*a*, the transmission arms 132 pivot about the axis 134. The pivotal movement of the transmission arms 132 moves the squeeze roller rotary shaft 133 connected to the transmission arms 132, whereby the squeeze roller 120 moves to the squeeze position. The shield moving mechanism 150 has the gears 151 rotatable about the squeeze roller rotary shaft 133. Consequently, the movement of the squeeze roller 120 rotates the gears 151 about the squeeze roller rotary shaft 133. As the gears 151 are rotated by the movement of the squeeze roller rotary shaft 133 about the axis 134, the shield 140 fixed to the gears 151 moves from the shielding position shown in FIG. 8 to the open position shown in FIG. 9.

Next, the first plate cylinder 11 is rotated clockwise in FIG. 9, with a load applied by the torque transmission clutch 116 to the leveling roller 111, and the squeeze roller 120 squeezing the printing plate against the peripheral surface of the first plate cylinder 11 (step S4).

As the first plate cylinder 11 is rotated in step S4, the printing plate is pulled in the direction of rotation of the first plate cylinder 11 by a stronger force than the load applied by the torque transmission clutch 116. The printing plate is wrapped around the peripheral surface of the first plate cylinder 11 while the printing plate is squeezed by the squeeze roller 120, with the forward end of the printing plate held by the forward end clamp mechanism 11*a*. Thus, the printing plate is attached to the peripheral surface of the first plate cylinder 11 without slackening the printing plate. The leveling roller rotary shaft 113 is connected to the one-way clutch 115. Thus, the leveling roller 111 and the driven roller 112 rotate freely when the printing plate moves past the leveling roller 111 and driven roller 112, whereby the printing plate is transported smoothly without slips occurring between the leveling roller 111, driven roller 112 and printing plate.

When the rear end of the printing plate has reached a position ready to be held by to the rear end clamp mechanism, the rotation of the first plate cylinder 11 is stopped (step S5). Then, the rear end of the printing plate is held by the rear end clamp mechanism (step S6).

In the embodiment described above, the leveling roller 111 is arranged to contact the back surface of each printing plate transported. Instead, the leveling roller 111 may be arranged to contact the front surface of each printing plate transported. However, it is preferable that the leveling roller 111 contacts the back surface which is a non-image recording surface.

In the embodiment described above, the torque transmission clutch 116 is connected to the leveling roller rotary shaft 113. Instead, the torque transmission clutch 116 may be connected to the driven roller rotary shaft 114.

Further, in the embodiment described above, one of the two transport rollers is the leveling roller 111 connected to the motor 117. Instead, both the transport rollers may be connected to a driving device to act as leveling rollers 111.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2004-119083 filed in the Japanese Patent Office on Apr. 14, 2004, the entire disclosure of which is incorporated herein by reference.

What is claimed is:

1. In a printing apparatus including a plate cylinder having a forward end clamp mechanism for holding a forward end of a printing plate, a storage unit storing printing plates to be exposed, and a plate feed mechanism arranged between the storage unit and the plate cylinder for feeding the printing plates from the storage unit to the plate cylinder, said plate feed mechanism comprising:

at least a pair of transport rollers;

drive means for rotating at least one of said pair of transport rollers;

a one-way clutch disposed between said drive means and said one transport roller driven by said drive means, for allowing said one transport roller to rotate freely in a transport direction of said printing plates; and load means for applying a load to at least one of said pair of transport rollers when said at least one transport roller rotates in the transport direction of said printing plates.

2. A printing apparatus as defined in claim 1, wherein said load means is arranged to apply the load to one of said pair of transport rollers that contacts a back surface of each printing plate.

3. A printing apparatus as defined in claim 1, wherein said load means comprises a torque transmission clutch connected to at least one of said pair of transport rollers.

4. A printing apparatus as defined in claim 3, wherein said torque transmission clutch is connected to said one transport roller driven by said drive means.

5. A printing apparatus as defined in claim 3, wherein said torque transmission clutch is arranged to apply the load to one of said pair of transport rollers that contacts a back surface of each printing plate.

6. A printing apparatus as defined in claim 1, wherein said drive means is arranged to stop driving said one transport roller after the forward end of said printing plate is held by said forward end clamp mechanism.

7. A printing apparatus as defined in claim 1, further comprising a squeeze roller movable between a squeeze position adjacent a periphery of said plate cylinder for squeezing said printing plate against the periphery of said plate cylinder, and a standby position spaced away from the periphery of said plate cylinder.

* * * * *